US006305293B1

(12) United States Patent
Fry et al.

(10) Patent No.: US 6,305,293 B1
(45) **Date of Patent: *Oct. 23, 2001**

(54) MULTIPLE-COMPONENT PROJECTILE WITH NON-DISCARDING SABOT SLEEVE

(75) Inventors: Grant Fry, Highland; Douglas Kay Furr, Lindon, both of UT (US)

(73) Assignee: Laser II, LLC, Highland, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,560

(22) Filed: Aug. 9, 1999

Related U.S. Application Data

(63) Continuation-in-part of application No. 09/059,876, filed on Apr. 14, 1998, now Pat. No. 6,186,071.

(51) Int. Cl.[7] ..... F42B 12/06

(52) U.S. Cl. ..... 102/517; 102/516; 102/518; 102/520; 102/527

(58) Field of Search ..... 102/514–527

(56) References Cited

U.S. PATENT DOCUMENTS

| | | | | |
|---|---|---|---|---|
| 622,582 | * | 4/1899 | Wyatt | 102/519 |
| 932,014 | | 8/1909 | Haase . | |
| 998,712 | * | 7/1911 | McNair | 102/526 |
| 1,040,927 | * | 10/1912 | Friedrick | 102/526 |
| 2,382,152 | | 8/1945 | Jakobsson | 102/93 |
| 2,996,012 | * | 8/1961 | Butler | 102/527 |
| 3,148,472 | | 9/1964 | Hegge et al. | 42/1 |
| 3,164,092 | | 1/1965 | Reed et al. | 102/93 |
| 3,786,760 | * | 1/1974 | Feldmann | 102/527 |
| 3,910,194 | * | 10/1975 | Dehm et al. | 102/527 |
| 3,935,816 | | 2/1976 | Boquette, Jr. | 102/41 |
| 4,381,712 | * | 5/1983 | Black | 102/503 |
| 4,653,404 | | 3/1987 | Halverson | 102/520 |
| 4,708,063 | * | 11/1987 | Ladriere | 102/516 |
| 5,038,684 | | 8/1991 | Petrovich | 102/515 |
| 5,175,392 | | 12/1992 | Denis | 102/364 |
| 5,183,963 | | 2/1993 | Beaufils et al. | 102/515 |
| 5,239,928 | | 8/1993 | Ricci | 102/439 |
| 6,085,662 | * | 7/2000 | Nilsson | 102/526 |

FOREIGN PATENT DOCUMENTS

| | | | |
|---|---|---|---|
| 308593 | 12/1919 | (DE) . | |
| 2431676 | 7/1978 | (FR) . | |
| 5960 * | 5/1885 | (GB) | 102/519 |
| 18589 | 1/1910 | (GB) . | |

* cited by examiner

*Primary Examiner*—Harold J. Tudor
(74) *Attorney, Agent, or Firm*—Kirton & McConkie; Michael F. Krieger

(57) ABSTRACT

The present invention comprises a multiple-component projectile which remains intact after leaving the barrel of a gun. The projectile comprises a core which includes a leading tip and a cylindrical shaft section which extends aft of the tip. A sabot sleeve surrounds the cylindrical shaft section and has a sufficient diameter to engage the rifling on the interior of a gun barrel. A rear cap connects to the aft end of the shaft section and secures the sabot sleeve to the shaft and tip. Preferred embodiments of the present invention comprise an annular lip and slot on the leading tip configured to receive the leading edge of the sabot sleeve and prevent it from separating from the core while traveling through the gun barrel and thereafter. The rear cap may also comprise an annular lip and slot configured to receive the trailing edge of the sabot sleeve and further lock the sleeve to the core thereby preventing longitudinal movement of the sleeve relative to the core. Longitudinal protruding fins on the interior of the sabot sleeve and complementary flutes on the exterior surface of the cylindrical shaft section also prevent independent rotation of the sleeve and core such that both will rotate in unison while traveling through a gun barrel and thereafter through the trajectory of the projectile.

11 Claims, 3 Drawing Sheets

MULTIPLE-COMPONENT PROJECTILE WITH NON-DISCARDING SABOT SLEEVE

This application is a continuation-in-part of the prior application Ser. No. 09/059,876 filed Apr. 14, 1998 now U.S. Pat. No. 6,186,071.

BACKGROUND OF THE INVENTION

1. The Field of the Invention

The present invention relates to projectiles and, more specifically, multiple component projectiles utilizing a non-discarding sabot for discharge from a rifled or smoothbore barrel.

2. Present State of the Art

Firearms, such as handguns and rifles, are designed to interact with a cartridge for discharging a projectile, commonly referred to as a bullet. A cartridge includes a metal case which houses a charge such as gun powder. Mounted at one end of the case is a primer. The projectile is crimped or otherwise secured to the opposing end of the case.

During operation, the cartridge is positioned within the chamber of a firearm. By depressing a trigger, a mechanical or electronic device initiates an action which ignites the gun powder which burns at an extremely fast and almost instantaneous rate. As the gunpowder bums, it produces a gas. The rapid expansion of the gas detaches the projectile from the case and pushes the projectile down and out the end of the barrel.

It has long been known that imparting an axial rotation to the projectile significantly improves the accuracy in which the projectile can be fired. Several approaches have been used to impart rotation to the projectile. The most common approach is to form a series of spiral grooves that longitudinally extend along the interior surface of the barrel. The projectile is configured to engage the grooves and thus rotate as the projectile travels the length of the barrel. Momentum allows the projectile to continue to spin after the projectile leaves the barrel.

Depending on the type of projectile used, different approaches have been used to engage the projectile and the grooves. For example, some projectiles are made from relatively soft lead alloys. During discharge, the force of the expanding gas causes the projectile to radially expand, thereby engaging the grooves. Where the projectile is made of a harder material, the projectile is configured having a diameter slightly larger than the inner diameter of the barrel. As a result, the projectile is forced into the grooves as the projectile travels within the barrel.

Although the operation of firearms has become a refined science, there are still several shortcomings associated with conventional projectiles. For example, extended firing, such as is commonly encountered in the military, results in wearing or deteriorating of the interior surface of the gun barrel. Significant wear on the barrel occurs much earlier when hard projectiles are used. The resulting wear on the barrel can produce irregular flight paths in the projectile and can reduce the speed and distance which the projectile travels. In such cases, it is necessary to replace the gun or at least the barrel thereof.

One additional problem with using lead alloy bullets is that they produce lead build-up on the interior surface of the barrel. Lead build-up increases the resistance on the projectile and can radically increase pressures as well as offset the flight path of the projectile. One approach to solving this problem has been to use various cleaning materials to remove the lead build-up from the interior surface of the barrel. This cleaning process, however, requires the use of toxic solvents that produce a harmful lead waste.

Discarding sabots have been used as another approach to overcoming some of the problems mentioned above. A discarding sabot is simply a plastic jacket that is placed over the projectile. During firing, the expanding gas results in expansion of the projectile and sabot such that the sabot, rather than the projectile, engages the grooves of the barrel. By engaging the grooves, the sabot rotates which in turn imparts a rotational movement to the projectile. As the projectile exits the barrel, the sabot is caught by the surrounding air and peeled off of the projectile, allowing the projectile to freely travel. The discarding sabot thus eliminates and prevents the need for the metal projectile to engage the interior surface of the barrel. As a result, wear on the barrel is minimized. Furthermore, there is no metal fouling or buildup in the barrel.

Although sabots produce some advantages, conventional discarding sabots also produce significant problems. For example, as a discarding sabot leaves the barrel, it rapidly expands to release the projectile. In some instances, the sabot breaks apart resulting in a fouled bore. Specifically, the discarding sabot can clog or otherwise obstruct such systems as sound suppressors, flash suppressors, gas recoil systems, recoil reduction systems, and bore evacuators. Furthermore, if the sabot does not evenly release the projectile, the projectile can become imbalanced and subsequently tumble.

OBJECTS AND BRIEF SUMMARY OF THE INVENTION

Accordingly, it is an object of the present invention to provide improved projectiles for firing from the barrel of a gun.

Another object of the present invention is to provide improved projectiles as above which minimize wear of the bore.

Yet another object of the present invention is to provide improved projectiles which maximize the effective rotation of the projectile as it is discharged from the barrel of the gun.

Another object of the present invention is to provide projectiles which do not result in bore fouling.

Still another object of the present invention is to provide increased velocity while reducing pressure within the barrel.

Finally, it is an object of the present invention to provide improved projectiles which maximize accuracy.

To achieve the foregoing objects, and in accordance with the invention as embodied and broadly described herein, a projectile is provided for firing from the barrel of a gun. The projectile comprises a core having an exterior surface extending from a leading conical tip to a substantially cylindrical shaft section. The projectile also includes a sabot sleeve which slips over the shaft section of the core. At the trailing edge of the projectile is a rear cap with a stem which fits into a bore at the rear of the cylindrical shaft section. The rear cap locks the sabot sleeve into position and prevents the sleeve from separating from the other projectile elements. The stem of the rear cap and the bore of the shaft section are constructed with a tight interference fit such that once pressed together they become virtually inseparable.

In one embodiment of the present invention, longitudinal interlock means are provided for mechanically locking the sabot sleeve onto the shaft section of the core such that the sabot remains attached to the shaft section and rear cap when the entire projectile is discharged from the barrel of the gun.

By way of example, the leading conical tip of the core tapers outwardly to an annular leading lip. The conical tip then tapers inward to meet the cylindrical shaft section. An annular leading slot is thereby created between the lip and the exterior surface of the shaft section. This annular slot is shaped to receive the leading edge of the sabot sleeve and prevent the sleeve from expanding and separating from the core.

The rear cap comprises a similar tapered surface which tapers outwardly from the rear face of the cap to form an annular trailing lip. The rear cap surface then tapers inwardly to form an annular trailing slot which is shaped to receive the trailing edge of the sabot sleeve.

During assembly, the cylindrical shaft section of the core is inserted into the sabot sleeve such that the leading edge of the sabot sleeve is received within the annular leading slot on the tip of the core. The stem of the rear cap is then inserted into the bore in the cylindrical shaft section and pressed fully into the bore with a hydraulic press. As the cap reaches its final position, the trailing slot on the rear cap engages the trailing edge of the sabot sleeve and prevents it from expanding and separating from the projectile. This interlocking of the complementary features between the core, cap and sabot sleeve prevents radial expansion at the front end of the sabot sleeve and longitudinal sliding of the sabot sleeve relative to the core. As a result of this engagement, the sabot remains attached to the core when the core, cap and sabot are discharged from the barrel of the gun.

The sabot is configured to engage the barrel of the gun so that the sabot rotates about a longitudinal axis as the sabot is discharged from the barrel of the gun. In one embodiment of the present invention, rotational interlock means are provided for mechanically locking the cylindrical shaft section of the core within the sabot sleeve such that the core rotates concurrently with the sabot as the sabot and core are discharged from the barrel of the gun. By way of example, a plurality of spaced-apart fins project inwardly from the inner side surface of the sabot sleeve. The fins are oriented parallel to the longitudinal axis of the projectile. A plurality of spaced apart flutes are longitudinally recessed within the cylindrical shaft section of the core. The flutes are complementary to the fins and are positioned such that the fins are received within the corresponding flutes when the cylindrical section of the core is received within the sabot sleeve. The interlocking of the flutes and fins requires the core to rotate concurrently with the sabot as the sabot and core are discharged from the barrel of the gun.

The inventive projectile with nondiscarding sabot has significant advantages over prior art projectiles. Like conventional discarding sabots, the nondiscarding sabot also functions to engage the grooves on the interior surface of the barrel. Since only the sabot engages the barrel, soft lead or extremely hard armor piercing metals can be used as the core without wearing or producing buildup on the interior surface of the barrel. Unlike conventional discarding sabots, however, the nondiscarding sabot remains attached to the core. As a result, there is no chance for the sabot to foul or otherwise obstruct the various systems which can be attached to the barrel of a gun. Likewise, there is no concern with the sabot being unevenly removed from the core which can imbalance the stability of the projectile.

Another significant advantage of the inventive projectile is that it can be more easily custom-designed for a desired purpose. For example, historically when it was desired to produce a projectile for penetrating armor, it was necessary to use a hardened projectile that could easily penetrate the armor, but would quickly wear the barrel. Alternatively, a softer projectile could be used that would not so rapidly wear the barrel. However, for the softer projectile to penetrate the armor, an increased charge needed to be used to increase the speed at which the projectile traveled. Increasing the charge, however, increases the danger in using the gun and also significantly increases the kick or recoil produced by the gun. By using the present invention, a core can be selected of a desired material to achieve a desired end. This can be accomplished without increasing wear on the barrel, the amount of charge used, or the resulting recoil.

An additional advantage of the present invention is an increased reliability and accuracy which derives from the use of an odd number of grooves and lands in the rotational interlock means. The barrels of most firearms utilize an even number of grooves for the spiral rifling on their interior surface. When an even number of grooves and lands are used for the rotational interlock means between the sabot and the shaft section, the lands on the projectile can align with each of the lands on the barrel rifling and prevent proper and consistent engagement of the projectile with the barrel rifling. When barrel lands and projectile lands line up, friction losses in the barrel and the sealing pressure of the sabot against the barrel will be different than when projectile lands line up with barrel grooves. This difference in friction and sealing effect will change the velocity and trajectory of the projectile. This alignment of barrel rifling land and projectile land will occur randomly as the cartridges enter the chamber of the firearm with a random rotational orientation. The result of this random alignment is an unpredictable or random spin and trajectory on successive projectiles which prevents accurate and reliable sighting and firing of the firearm. This land alignment problem is avoided when an odd number of lands and grooves are used for the rotational interlock means between the sabot sleeve and the projectile core.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description. It will be readily understood that the components of the present invention, as generally described and illustrated in the figures herein, could be arranged and designed in a wide variety of different configurations. Thus, the following more detailed description of the embodiments of the system and apparatus of the present invention, as represented in the Figures, is not intended to limit the scope of the invention, as claimed, but it is merely representative of the presently preferred embodiments of the invention.

Figure 1:
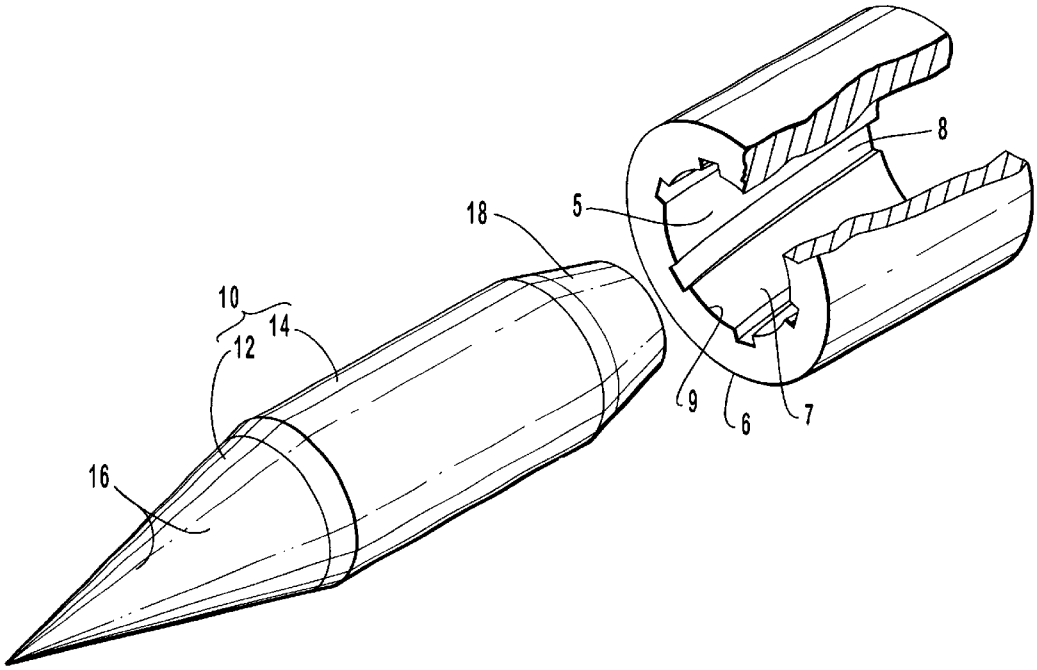
FIG. 1 is a perspective view of an inventive projectile having a core, rear cap and a non-discarding plastic sabot being discharged from the barrel of a gun.

Depicted in FIG. 1 is one embodiment of a projectile 10 incorporating features of the present invention. Projectile 10 comprises a core 12 with a leading tip section 16, and a cylindrical shaft section 20 (not shown) over which a non-discarding sabot sleeve 14 is placed and a rear cap 18. Although not depicted, projectile 10 is configured for attachment to the case of a conventional cartridge and can be selectively discharged from a barrel 6 of a gun, such as a rifle or hand gun. Barrel 6 has in interior surface 7 bounding a bore 5. A plurality of spiral grooves 8 are recessed on interior surface 7 and extend the length of barrel 6. Extending between each of grooves 8 are lands 9.

Figure 2:
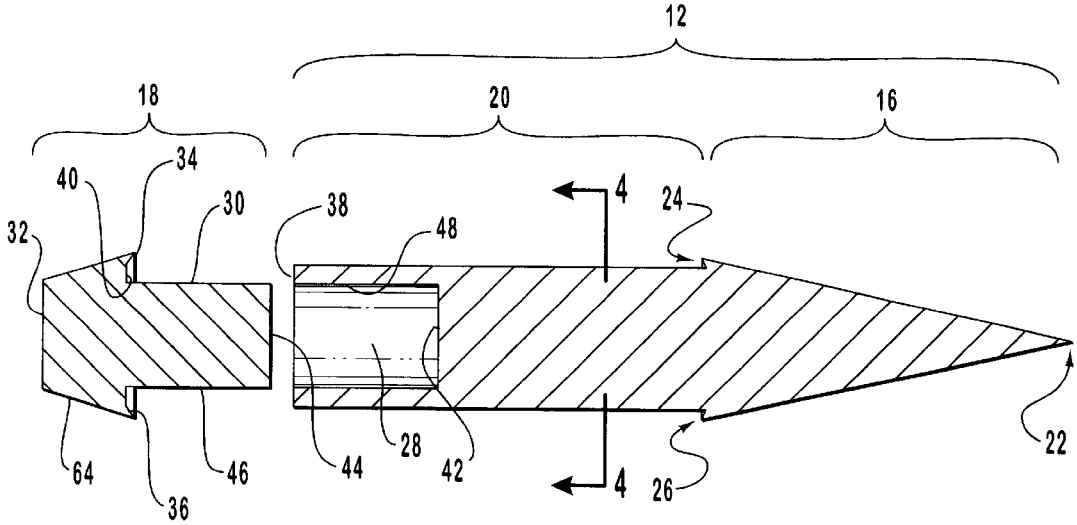
FIG. 2 is a longitudinal cross-sectional view of the core and rear cap of a preferred embodiment of the present invention.

In reference to FIG. 2, core 12 has a leading tip 16 which may have a conical shape which tapers outwardly from a point 22 to an annular leading lip 24 after which leading tip 16 tapers inwardly to intersect with cylindrical shaft section 20 thereby forming an annular leading slot 26. Leading tip 16 may take a traditional conical shape such as a cone with a triangular cross-section or may take the shape of a cone with arcuate sides in cross-section such as is common in the projectile industry. Leading tip 16 may also take other shapes including, but not limited to, the "hollow-point" or "wadcutter" shaped projectiles known in the art.

Cylindrical shaft section 20 of core 12 extends aft of leading tip 16 and is configured to receive sabot sleeve 14 around its circumference. Cylindrical shaft section 20 typically has a substantially circular cross-section with grooves formed therein to provide rotational interlock means between the cylindrical shaft section 20 and the sabot sleeve 14.

At the rear end of cylindrical shaft section 20, a cavity 28 is formed therein. In a preferred embodiment, cavity 28 is circular in cross-section and co-axial with cylindrical shaft 20. Cavity 28 is generally configured to receive and be complementary to stem 30 of rear cap 18 such that stem 30 will fit into cavity 28 with an interference fit, however, other means may be used to connect rear cap 18 to shaft 20 other than an interference fit.

Rear cap 18 comprises stem 30 as well as a rear face 32. From rear face 32 rear cap 18 tapers outwardly to a trailing tip 34 then tapers inwardly toward the rear of the projectile to intersect with annular rear cap surface 40 thereby forming trailing annular slot 36 which is configured to receive the trailing edge of sabot sleeve 14. Forward stem face 44 is located at the forward end of stem 30.

In a preferred embodiment, rear cap 18 is connected to cylindrical shaft section 20 by pressing stem 30 into cavity 28 thereby locking sabot sleeve 14 into position and completing assembly of projectile 10. As stem 30 is pressed into cavity 28, an interference fit causes cap mating surface 46 and shaft mating surface 48 to frictionally engage thereby preventing removal or separation of rear cap 18 from core 12. As stem 30 reaches its final position, cap annular surface 40 and shaft annular surface 38 may contact so as to prevent distortion or damage to sabot sleeve 14. As it may take several thousand pounds of force to effectuate the interference fit between stem 30 and cavity 28, and sabot sleeve 14 is a flexible material, this positive stop mechanism is necessary in some embodiments.

A positive stop mechanism may also be achieved through contact between forward stem face 44 and forward cavity face 42.

Figure 3:
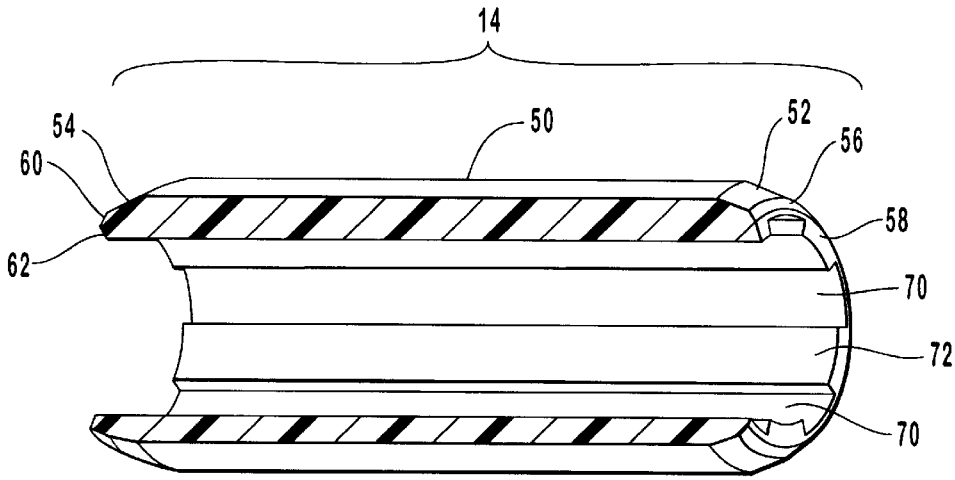
FIG. 3 is a longitudinal cross-sectional view of the sabot sleeve of a preferred embodiment of the present invention.

In reference to FIG. 3, sabot sleeve 14 comprises an exterior surface 50 with a substantially constant diameter which is configured to engage the interior surface of a barrel of a firearm of a specific caliber. Exterior surface 50 extends from a leading tapered surface 52 to a trailing tapered surface 54. The shape and configuration of leading tapered surface 52 may vary between applications and projectile types, however, in a preferred embodiment, leading tapered surface 52 matches the angle of leading tip 16 of core 12 such that the shape of leading tip 16 is extended onto leading tapered surface 52. This configuration provides a smooth aerodynamic shape to the tip-to-sabot transition.

Sabot leading edge 58 and sabot leading annular engagement surface 56 are shaped to engage and complement leading annular slot 26 such that, when sabot sleeve 14 is assembled to core 12, annular tip 24 and leading annular slot 26 contact surface 56 and edge 58 and prevent sabot sleeve 14 from expanding away from core 12 and from sliding longitudinally relative to core 12.

Likewise sabot trailing edge 62 and sabot trailing annular engagement surface 60 engage and are complementary to trailing annular slot 36 and trailing tip 34. As with the leading end of the projectile, a preferred embodiment of the sabot of the present invention utilizes a trailing tapered surface 54 which conforms with the rear tapered surface 64 of rear cap 18. Other shapes may also be used for trailing tapered surface 54 so long as they do not affect the positive lock of engagement surface 60 and trailing edge 62 with slot 36 and so long at the trajectory of the projectile is not adversely affected.

Cylindrical shaft section 20 of core 12 is configured to be received within sabot sleeve 14. Once rear cap 18 is in place, sabot sleeve 14 is prevented from moving in a longitudinal direction, either forward or backward by engagement between leading edge 58 and leading slot 26 and between trailing edge 62 and trailing slot 36, thus, in the illustrated embodiment, longitudinal interlock means are provided for mechanically locking core 12 and shaft 20 with sabot sleeve 14 such that sabot sleeve 14 remains attached to core 12 when core 12 and sabot sleeve 14 are discharged from barrel 6 of a gun.

As the combined sabot sleeve 14, core 12, and rear cap 18 are discharged from barrel 6 of a gun, air friction, core acceleration and other forces attempt to strip sabot sleeve 14 off of core 12. Leading edge 58 of sabot sleeve 14, however, is prevented from radial expansion as a result of being captured within slot 26 of core 12. Simultaneously, sabot sleeve 14 is prevented from sliding back on core 12 as a result of trailing edge 62 being engaged within slot 36.

Sabot sleeve 14 can be made out of a variety of different plastics or composites thereof. In one embodiment, sabot sleeve 14 is made of polycarbonate combined with a softer plastic such as polyester or polypropylene. Examples of acceptable materials include combinations of polycarbonate and Xenoy® or Delrin® synthetic resin available from General Electric and DuPont. Although a variety of different materials can be used, the material must be sufficiently rigid so that sabot sleeve 14 is not deformed and pulled off of core 12 during discharge. To minimize friction resistance between sabot sleeve 14 and barrel 6, it is also desirable that sabot sleeve 14 be made of a material having a low friction factor.

Sabot sleeve 14 can be made using a variety of different process methods. For example, sabot sleeve 14 can be injection molded using a mold core that is subsequently removed from sabot sleeve 14. Alternatively, sabot sleeve 14 can be directly injection molded onto core 12. In one injection molding process, the mold base is comprised of a split base-plate mold. In yet other embodiments, sabot sleeve 14 can be made using a dipping process or a flow around process.

One of the functions of sabot sleeve 14 is to engage grooves 8 formed on interior surface 7 of barrel 6. As a result of sabot sleeve 14 engaging grooves 8, sabot sleeve 14, and thus core 12, rotates or spins around the longitudinal axis of projectile 10. To engage sabot sleeve 14 with barrel 6, sabot sleeve 14 is nominally oversized such that sabot sleeve 14 is larger in diameter than bore 5. In the firing process, sabot sleeve 14 is wedged to fit the diameter of bore 5. High lubricity of sabot sleeve 14 materials allows minimal friction within bore 5. Sabot sleeve 14 expands into grooves 8, thereby facilitating the desired engagement for rotation. Expansion of sabot sleeve 14 also helps to capture the gas behind projectile 10 within barrel 6. As a result, the force of the gas on projectile 10 is maximized.

In alternative embodiments, core 12 can be made of harder materials such as stainless steel, uranium, or titanium. In these embodiments, sabot sleeve 14 needs to again have an outer diameter that is slightly larger than the inner diameter of lands 9 of grooves 8. Accordingly, as projectile 10 travels within bore 5, sabot sleeve 14 engages within grooves 8, thereby imparting the desired rotation. Since only sabot sleeve 14 and not core 12 engages barrel 6, core 12 can be made out of any material that can withstand the force of the discharge. For example, core 12 can be made out of metals, plastics, or composites.

Since core 12 is typically made of a denser material than sabot sleeve 14, core 12 resist rotating currently with sabot sleeve 14. Accordingly, the present invention also includes rotational interlock means for mechanically locking core 12 within sabot sleeve 14 such that core 12 rotates concurrently with sabot sleeve 14 as the combined sabot sleeve 14 and core 12 travel through barrel 6 and are discharged therefrom.

Figure 4A:
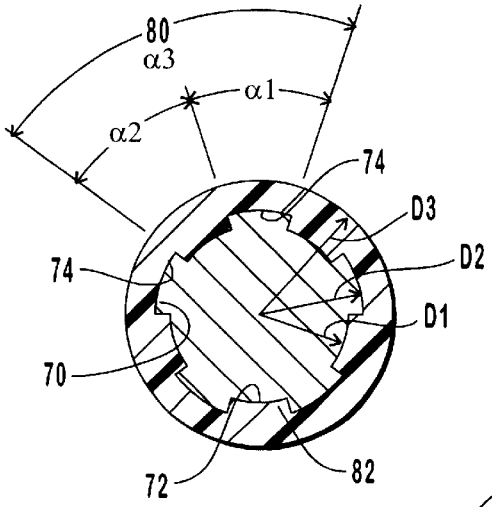
FIGS. 4A and B are transverse cross-sectional views of the cylindrical shaft sections of the cores of preferred embodiments of the present invention.
Figure 4B:
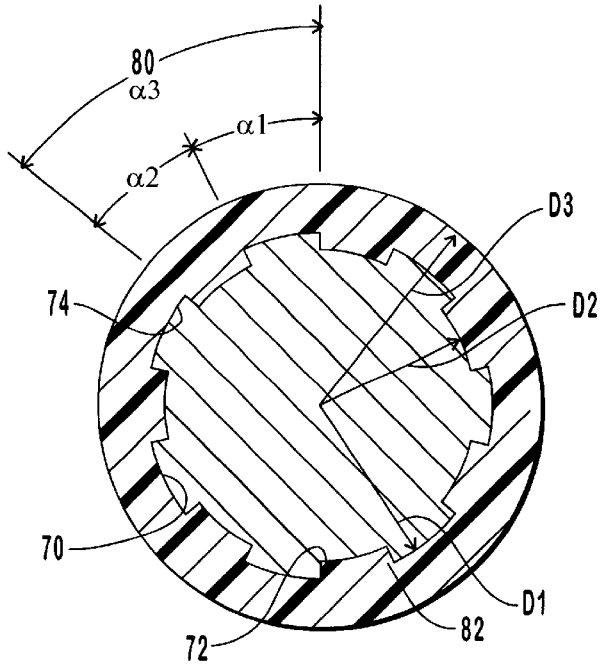

By way of example and not by limitation, depicted in FIGS. 4A and 4B are a plurality of spaced apart fins 72 inwardly projecting from inner sleeve surface 70 of sabot sleeve 14. Fins 72 are oriented parallel with the longitudinal axis of sabot sleeve 14 and may extend from leading edge 58 to trailing edge 62.

The rotational interlock means further includes a plurality of spaced apart flutes 74 longitudinally recessed within cylindrical shaft section 20 of core 12. Flutes 74 have a configuration complementary to fins 72 and are positioned such that fins 72 are received within corresponding flutes 74 when shaft 20 is received within sabot sleeve 14.

During assembly, core 12 is inserted into the interior of sabot sleeve 14, as previously discussed, so that fins 72 are snugly received within corresponding flutes 74. The engagement between fins 72 and flutes 74 prevents core 12 from rotationally slipping within sabot sleeve 14. As a result, core 12 rotates concurrently with sabot sleeve 14. To ensure that core 12 does not slip within sabot sleeve 14, flutes 74 need to be sufficiently deep that the corresponding fin 72 is securely held therein. Flutes 74, however, should not be so deep that core 12 is structurally weakened.

In alternative embodiments for the rotational interlock means, the present invention also envisions that flutes 74 on core 12 and fins 72 on sabot sleeve 14 can be reversed.

To improve the accuracy in which projectile 10 travels, it is desirable that the discharge force be uniformly applied to projectile 10 and that the frictional forces exerted on projectile 10 by barrel surfaces be uniformly applied also. If the these force are unevenly applied to projectile 10 within barrel 6, projectile 10 will be unstable after it leaves barrel 6. As a result, projectile 10 can become unbalanced and subsequently begin to tumble or otherwise stray from a desired course. Since pressure within barrel 6 is lower within grooves 8 than on lands 7, it is preferred that when an even number of grooves 8 are present, projectile 10 has an odd number of flutes 74 and corresponding fins 72. Likewise, if an even number of grooves 8 are present, it is preferred, although not necessary, that an even number of flutes 74 and corresponding fins 72 be used.

For example, in 0.223 caliber guns which typically have four grooves 8, it is preferred to a have five flutes 74 as shown in FIG. 4A. Likewise, in 0.30 and 0.50 caliber guns which typically have six grooves 8, it is preferred to a have an odd number of flutes 74. In 0.30 caliber guns, five flutes 74 are preferred, however in the larger 0.50 caliber guns, seven flutes 74 are preferred as shown in FIG. 4B.

By way of example and not by limitation, in one embodiment of projectile 10 used with a 0.223 caliber gun, as depicted in FIG. 4A, cylindrical shaft section 20 and sabot sleeve 14 are divided into five equal radial sections 80 each having a flute 74 and a fin 72. Each of sections 80 has a section angle $\alpha_3$ of 72°. Within each section 80, flute 74 may cover a flute angle $\alpha_1$ , in a range between about 10° to about 62° with a preferred angle of about 36°. Each fin 72 may also cover a fin angle $\alpha_2$ in a range between about 10° to about 62° with a preferred angle of about 36°. In an embodiment suitable for a 0.223 caliber gun, the diameter $D_1$ of the interior surface of fins 72 is about 0.1545 inches. The diameter $D_2$ of the interior surface of grooves 74 is about 0.1745 inches and the diameter $D_3$ of the exterior surface of sabot sleeve 14 is about 0.2245 inches. These same dimension are depicted for a 0.50 caliber embodiment of the present invention with 7 fins 72 and flutes 74 in FIG. 4B.

Other relevant preferred dimensions for fin and groove spacing of example embodiments of projectile 10 for use with 0.223, 0.30 and 0.50 caliber firearms are set forth below in Table 1. The reference letters in Table 1 correspond to the dimensions depicted in FIGS. 4A and 4B.

TABLE 1

| Dimension | .223 Caliber | .30 Caliber | .50 Caliber |
|---|---|---|---|
| Number of fins | 5 | 5 | 7 |
| $\alpha_1$ | about 36° | about 36° | about 26° 33' |
| $\alpha_2$ | about 36° | about 36° | about 24° 53' |
| $\alpha_3$ | about 72° | about 72° | about 51° 26' |
| $D_1$ | 0.1545" | 0.1745" | 0.2245" |
| $D_2$ | 0.2060" | 0.2400" | 0.3090" |
| $D_3$ | 0.3593" | 0.4000" | 0.5130" |

Figure 5A:
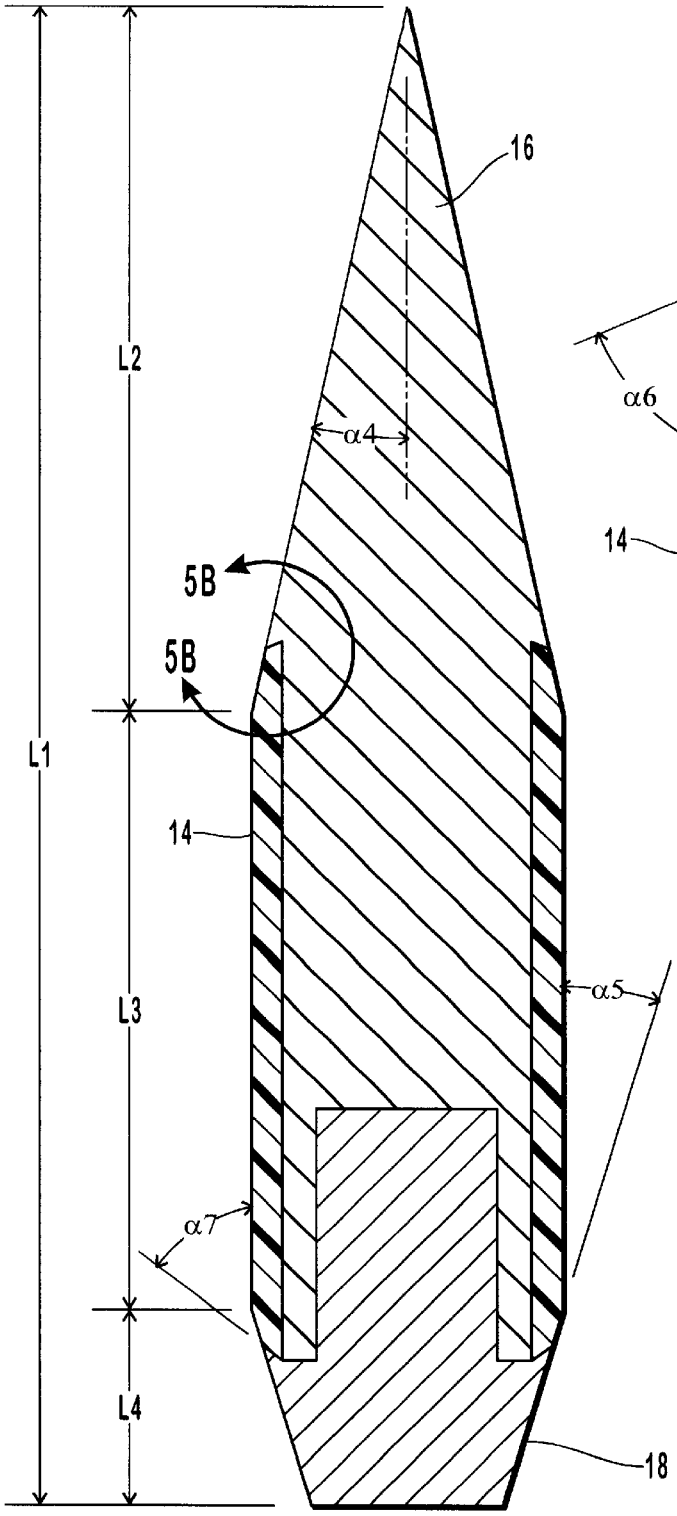
FIG. 5 is a longitudinal cross-sectional view of an assembled projectile of a preferred embodiment of the present invention showing the core, sabot sleeve and rear cap.
Figure 5B:
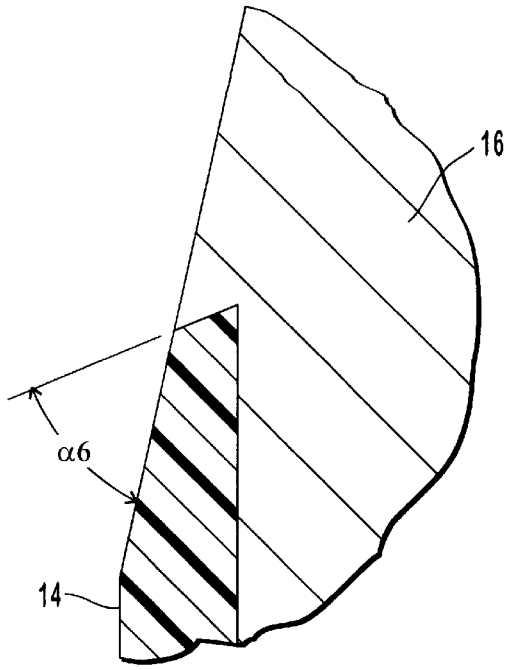

Other relevant dimensions for manufacturing example embodiments of projectile 10 for use with 0.223, 0.30 and 0.50 caliber firearms are set forth below in Table 2. The reference letters in Table 2 correspond to the dimensions depicted in FIGS. 5A and 5B.

TABLE 2

| Dimension | .223 Caliber | .30 Caliber | .50 Caliber (7 fins) |
|---|---|---|---|
| $\alpha_4$ | about 12° 5' | about 14° 0' | about 15° 9' |
| $\alpha_5$ | about 17° | about 17° | about 17° |
| $\alpha_4$ | about 12° 5' | about 14° 0' | about 15° 9' |
| $\alpha_6$ | about 60° | about 60° | about 60° |
| $\alpha_7$ | about 60° | about 60° | about 60° |
| $L_1$ | 1.10" | 1.569" | 2.75" |
| $L_2$ | 0.5244" | 0.6197" | 0.9474" |
| $L_3$ | 0.4284" | 0.7040" | 1.4026" |
| $L_4$ | 0.1472" | 0.2453" | 0.4000" |

In reference to FIG. 5, where a cross-section of an assembled projectile of a preferred embodiment of the present invention is shown, the overall length $L_1$ of projectile 10 is shown. Leading taper length $L_2$ extends from leading point 22 past annular leading tip 24 and onto sabot sleeve 14 where it continues until it intersects with the exterior surface of sabot sleeve 14 thereby creating leading tapered surface 52. Likewise, rear taper length $L_4$ extends from rear face 32 past trailing annular tip 34 and onto the exterior surface of sabot sleeve 14 thereby creating trailing tapered surface 54. Projectile 10 and sabot sleeve 14 have a substantially uniform outside diameter between leading tapered length $L_2$ and rear taper length $L_4$, this uniform diameter length $L_3$ is located wholly on the sabot sleeve 14.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A projectile for firing from the barrel of a gun, comprising:

a core having a leading tip located on a leading end of said core and having a cylindrical shaft section with an outer and inner diameter, wherein said outer diameter of said cylindrical shaft section has flutes and fins protruding annularly around said outer diameter of said cylindrical shaft section, wherein said cylindrical shaft section connects to said leading tip to form a leading annular slot between said leading tip and said cylindrical shaft section;

a rear cap having a stem, wherein said stem is frictionally fit within a cavity defined by said inner diameter of said cylindrical shaft section, wherein said cavity partially extends from said trailing end of said core toward said leading end of said core, and wherein a trailing annular slot is formed between said rear cap and said trailing end of said core when said stem of said rear cap is frictionally fit within said cavity;

a sabot sleeve that remains with said core and said rear cap after firing, said sabot sleeve encompassing said cylindrical shaft section of said core, wherein said sabot sleeve has an inner diameter and an outer diameter and has a leading edge and a trailing edge, wherein said sabot sleeve has flutes and fins protruding annularly and inwardly from said inner diameter of said sabot sleeve and extending substantially the entire length of said sabot sleeve and wherein said sabot sleeve rotationally interlocks said cylindrical shaft section by the complementary mating of flutes and fins located on both said inner diameter of said sabot sleeve and on said outer diameter of said cylindrical shaft section, and further, wherein said sabot sleeve becomes longitudinally interlocked onto said cylindrical shaft section by said leading edge of said sabot sleeve being received within said leading annular slot and by said trailing edge of said sabot sleeve being received within said trailing annular slot.

2. The projectile of claim 1, wherein said outer diameter of said sabot sleeve has a smooth surface.

3. The projectile of claim 1, wherein said core is composed of a material selected from the group consisting of lead, stainless steel, uranium and titanium.

4. The projectile of claim 1, wherein said sabot sleeve is constructed from polycarbonate combined with a synthetic resin.

5. The projectile of claim 4, wherein said synthetic resin is polyester or polypropylene.

6. The projectile of claim 1, wherein said leading tip has a conical shape and said conical shape extends onto a surface of said sabot sleeve.

7. The projectile of claim 1, wherein said rear cap has a truncated conical shape and said conical shape extends onto a surface of said sabot sleeve.

8. The projectile of claim 1, for use in a barrel of a rifle, wherein said barrel has an inner diameter, and wherein said inner diameter has an even or odd number of grooves protruding annularly and inwardly from said inner diameter of said barrel which engage said sabot sleeve.

9. The projectile of claim 8, wherein an even number of grooves are present on said inner diameter of said barrel when an odd number of said flutes and fins are present on said inner diameter of sabot sleeve.

10. The projectile of claim 8, wherein an odd number of grooves are present on said inner diameter of said barrel when an even number of said flutes and fins are present on said inner diameter of sabot sleeve.

11. The projectile of claim 8, wherein said outer diameter of said sabot sleeve is larger than said inner diameter of said barrel, such that said outer diameter of sabot sleeve expands into said grooves of said inner diameter of said barrel when projectile is fired to cause said sabot sleeve and said core and said rear cap to rotate concurrently throughout said barrel upon firing.

* * * * *